US005521687A

United States Patent [19]

Bors et al.

[11] Patent Number: 5,521,687

[45] Date of Patent: *May 28, 1996

[54] METHOD OF REMOVING IMPURITIES FROM A TRANSPORT MEMBER DURING AN ELECTROSTATIC IMAGING PROCESS

[75] Inventors: Theodorus W. P. Bors, Reuver; Hubertus A. M. Loonen, Haps, both of Netherlands

[73] Assignee: Oce-Nederland, B.V., Venlo, Netherlands

[ * ] Notice: The term of this patent shall not extend beyond the expiration date of Pat. No. 5,343,277.

[21] Appl. No.: 93,657

[22] Filed: Jul. 20, 1993

[30] Foreign Application Priority Data

Jul. 27, 1992 [NL] Netherlands ..... 9201348

[51] Int. Cl.[6] ..... G03G 21/00

[52] U.S. Cl. ..... 355/271; 355/215; 355/296

[58] Field of Search ..... 355/296, 271, 355/273, 200, 305, 307, 301, 297, 275, 279, 281, 215; 15/299, 256.5; 118/652; 430/125

[56] References Cited

U.S. PATENT DOCUMENTS

| | | | |
|---|---|---|---|
| 3,807,853 | 4/1974 | Hudson | 355/298 |
| 4,588,279 | 5/1986 | Fukuchi et al. | 355/271 |
| 4,607,947 | 8/1986 | Ensing et al. | 355/296 X |
| 4,657,373 | 4/1987 | Winthaegen et al. | 355/275 |
| 4,706,320 | 11/1987 | Swift | 15/256.5 X |
| 4,970,560 | 11/1990 | Lindblad et al. | 355/299 |
| 4,978,999 | 12/1990 | Frankel et al. | 355/299 |
| 5,117,264 | 5/1992 | Frankel et al. | 355/299 |
| 5,243,392 | 9/1993 | Berkes et al. | 355/275 |
| 5,264,903 | 11/1993 | Nagame et al. | 355/297 |
| 5,343,277 | 8/1994 | Rooijakkers et al. | 355/271 |
| 5,361,126 | 11/1994 | Loonen et al. | 355/271 X |

FOREIGN PATENT DOCUMENTS

| | | |
|---|---|---|
| 0212685 | 3/1987 | European Pat. Off. . |
| 61-100782 | 5/1986 | Japan . |

OTHER PUBLICATIONS

Thompson, Philip, "Fiber Traps and Copiers", Xerox Disc. Journal, Sep./Oct. 1988, vol. 13, No. 5, pp. 265–266.

*Primary Examiner*—Arthur T. Grimley
*Assistant Examiner*—Shuk Y. Lee
*Attorney, Agent, or Firm*—Birch, Stewart, Kolasch & Birch

[57] ABSTRACT

An imaging apparatus including a device for transferring a toner image from an image-forming medium to a receiving material including an endless movable intermediate provided with a top layer which, in a first transfer zone, is in contact with the image-forming medium, a heating device for heating the toner image on the top layer of the intermediate, a pressure applying device which, in a second transfer zone, can be brought into contact with the intermediate, a transport device for transporting the receiving material through the second transfer zone, and a cleaning device following the second transfer zone, between the second and first transfer zones, brought into contact with the top layer of the intermediate, the cleaning device being provided with an impurity-absorbent material on its outer surface.

18 Claims, 1 Drawing Sheet

METHOD OF REMOVING IMPURITIES FROM A TRANSPORT MEMBER DURING AN ELECTROSTATIC IMAGING PROCESS

BACKGROUND OF THE INVENTION

1. Field of the Invention

The present invention relates to an electrostatic imaging system and more specifically to an apparatus for transferring a toner image from an image-forming medium to a receiving material via an intermediate transfer member and cleaning the intermediate transfer member.

2. Discussion of Related Art

U.S. Pat. No. 4,607,947 describes a contact fixing apparatus in which a toner image is transferred from an image-forming medium to a heated intermediate. In a fixing zone in which the intermediate is in contact with a pressure applying means, the toner image is then transferred to and simultaneously fixed on a receiving material transported through the fixing zone. However, impurities may also be transferred at the same time from the receiving material to the intermediate. Residues of toner material may also be left as impurities on the intermediate because of inadequate transfer of the toner image to the receiving material. If such impurities remain on the intermediate they may be transferred to the image-forming medium in the first transfer zone. This results in disturbance of the image formation and hence ultimately image errors in the copy on the receiving material.

Various cleaning means have been proposed to remove these impurities from the intermediate before reaching the first transfer zone. For example, U.S. Pat. No. 4,607,947 discloses a cleaning means having a cleaning surface to which the toner has better adhesion than to the intermediate. A cleaning means of this kind operates satisfactorily for removing high-melting temperature impurities, such as toner residues. This cleaning means can also remove paper dust from the intermediate, but it has been found in practice that low-melting impurities from receiving materials, such as wax-like compounds, plasticizers, anti-foaming agents, plastic fillers which occur in receiving papers, and dust particles from plastic receiving materials and the like, are removed only partially, if at all, from the intermediate with the known cleaning means. After deposition on the intermediate in the second transfer zone, these impurities can also then be transferred to the image-forming medium in the first transfer zone, resulting in disturbance of the image formation and hence ultimately image errors in the copy on the receiving material. This necessitates regular and premature replacement of the intermediate and image-forming medium, and this involves high maintenance costs and equipment stoppage. For example, it has been found that the "alkaline" receiving papers increasingly used and based, inter alia, on cellulose, chalk and sizing agents such as alkyl ketone dimers, are a significant source of such impurity. Receiving papers of this kind are currently used because of the lower costs and better durability compared with the "acid" receiving papers based, inter alia, on cellulose, clay and modified or unmodified rosins. It has now been found that when alkaline receiving papers are used reaction products from the agents used in sizing are deposited from these receiving papers on the intermediate and penetrate into the top layer. These reaction products are then transferred to the image-forming medium, resulting in image disturbance.

SUMMARY OF THE INVENTION

Therefore, it is an object of the present invention to provide a toner-image transfer system which will overcome the above noted disadvantages.

It is a further object of the instant invention to provide an image transfer apparatus which provides for the transfer of toner images to an image-receiving material without the deposition of impurities on the image-forming medium.

Still, a further object of the present invention is to provide a toner image transfer system which substantially eliminates impurity deposits which result in the disturbance of image formation.

The foregoing objects and others are accomplished in accordance with the present invention, generally speaking, by providing an image-forming apparatus including an image-forming medium, means of forming an image on the image-forming medium, a toner image development system and a configuration for transferring the developed toner image from the image-forming medium to a first image-receiving support member or sheet material. The image transfer configuration includes an endless movable intermediate member provided with a top layer which, in a first transfer zone, is contacted with the image-forming medium for the purpose of transferring the toner image developed to the surface of the intermediate member. A heating means is provided for heating the transferred toner image now on the top layer of the intermediate member. A pressure applying means is brought into contact with the intermediate member within a second transfer zone. A transport means transports a receiving material through the second transfer zone in which the toner image is transferred to the receiving material. A cleaning means provided with an impurity-absorbent material is positioned following the second transfer zone and between the first and second transfer zones to be brought into contact with the top layer of the intermediate member.

The quantity of impurity on the intermediate member and its deposition on the image-forming medium are reduced as a result of the use of the impurity absorbent material, so that the life of the intermediate member and the image-forming medium, i.e. the period during which these media can be used without any image errors occurring, is lengthened. Preferably an impurity-absorbent rubber material is used. Particularly preferred is a rubber material which can absorb therein a distearyl ketone up to more than 5% of its weight.

Good cleaning of the intermediate medium is obtained in an apparatus in which the impurity-absorbent material used is a rubber material selected from the group consisting of ethylene propylene diene rubber, ethylene propylene rubber, a mixture of ethylene propylene diene rubber and silicone rubber, ethylene vinyl acetate rubber, n-butyl rubber and mixtures of these rubbers. Particularly preferred rubber materials are those selected from the group consisting of ethylene propylene diene rubber, ethylene propylene rubber, n-butyl rubber, ethylene vinyl acetate rubber, silicone rubber and mixtures of these rubbers, containing more than 5% carbon black. Rubbers of this kind are resistant to high temperatures and have sufficient mechanical strength even after long periods of use.

BRIEF DESCRIPTION OF THE DRAWINGS

The invention will now be explained with reference to the accompanying FIG. 1 which is a diagrammatic cross-section through one embodiment of the apparatus according to the present invention.

DETAILED DISCUSSION OF THE INVENTION

Figure 1:
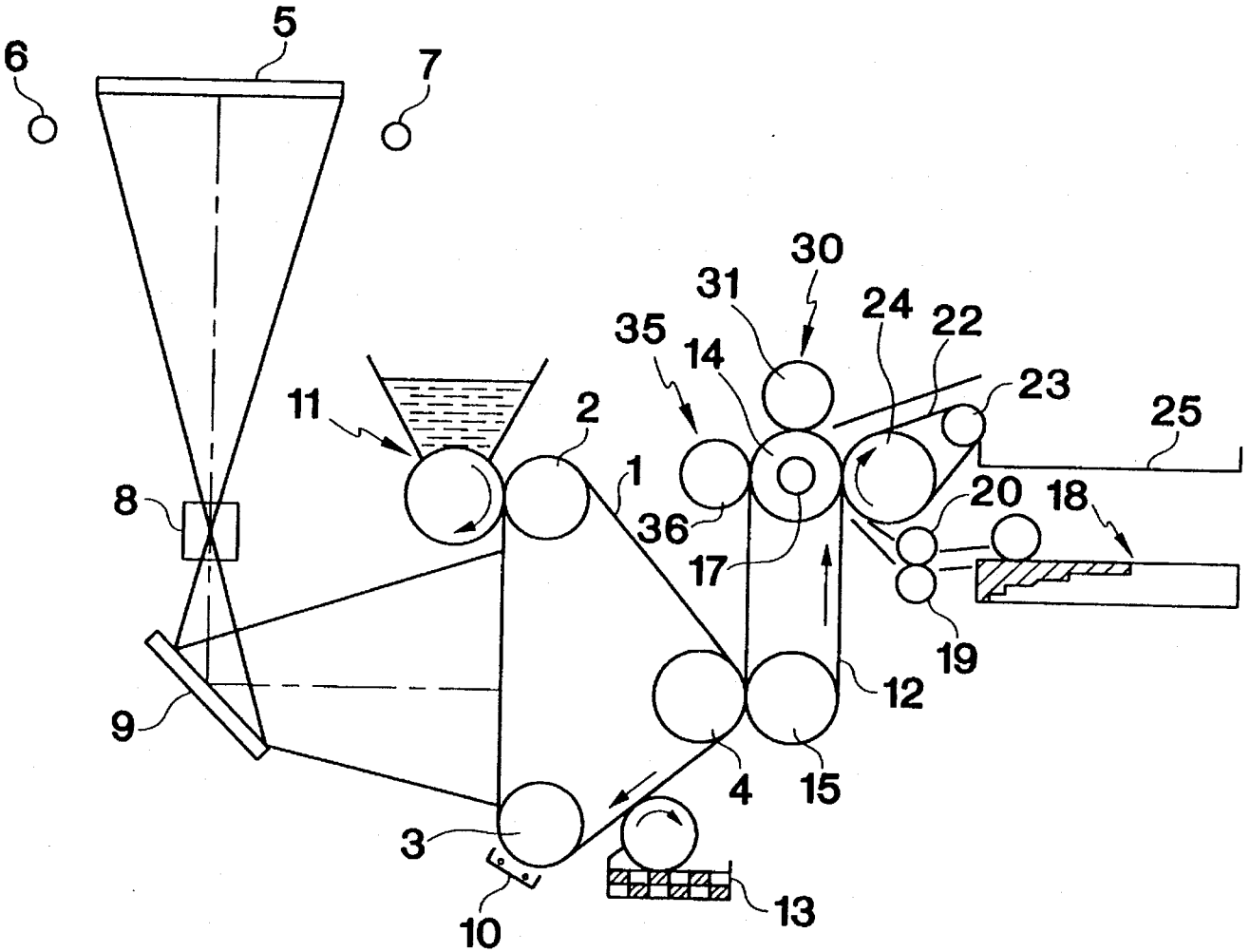

The image-forming apparatus illustrated comprises an endless photoconductive belt 1 advanced at uniform speed by means of drive and guide rollers 2, 3 and 4, respectively.

The image of an original disposed on an exposure platen 5 is projected by flashlights 6 and 7, a lens 8, and a mirror 9, onto the belt 1 after the latter has been electrostatically charged up by a corona device 10. The latent charge image formed on the belt 1 after the flash exposure is developed with toner powder by means of a magnetic brush device 11 to give a toner image which in a first transfer zone is then brought into contact under pressure with an endless intermediate belt 12 provided with a top layer of soft resilient and heat-resistant material such as, for example, silicone rubber. In these conditions the toner image is transferred from the belt 1 to the belt 12 by adhesion forces.

After this image transfer, any remaining image residues are removed from belt 1 by means of a cleaning device 13, whereafter the photoconductive belt 1 is ready for re-use. The intermediate belt 12 is trained about drive and guide rollers 14 and 15, the intermediate belt 12 being heated to a temperature above the softening temperature of the toner powder, e.g. by means of an infra-red radiator 17, disposed inside roller 14. While belt 12 with the toner image thereon is advanced, the heating causes the toner image to become tacky. In a second transfer zone, under the influence of pressure, using a pressure means in the form of a belt 22 trained about rollers 23 and 24, the tacky toner image is then transferred to and simultaneously fixed on a sheet of receiving material which is fed from reservoir 18 via rollers 19 and 20. Toner residues are removed by a first cleaning means 30 in the form of a roller 31 in accordance with U.S. Pat. No. 4,607,947. The resulting copy is then deposited by belt 22 in tray 25.

To remove the impurities from the intermediate belt 12, the apparatus is provided with a second cleaning means 35, e.g. in the form of a freely rotatable roller 36 provided with a layer of peroxide hardened silicone rubber in which about 15% carbon black, having a specific surface of about 900 $m^2/g$, is mixed. The choice of specific absorbent material depends on the type of impurity, the maximum amount of impurity which can be absorbed in the absorbent material, the absorption capacity, and the speed at which the impurity is absorbed in this material, i.e. the absorption speed. The absorption capacity and the absorption speed of a specific impurity can easily be determined by bringing such impurity into contact, in solid, liquid or dissolved form, with the absorbent material and monitoring the increase in weight of such absorbent material in the course of time.

A model compound having an affinity comparable to that of the impurity for the top layer of the intermediate can also be used as an impurity. The absorption capacity for the low-melting impurities from alkaline papers is determined, for example, by bringing the absorbent material into contact, at about 100° C., for 24 hours with distearyl ketone, a dialkyl ketone compound, and measuring the increase in weight. The absorption capacity of various materials is given in the following Table 1.

TABLE 1

| MATERIAL | ABSORPTION CAPACITY (% weight increase of the rubber) |
|---|---|
| Addition-hardened silicone rubber LIM 2600 (General Electric Co) | 4.4 |
| Peroxide-hardened silicone rubber (Wacker R300-50) | 3.6 |
| EPDM Rubber (ethylene-propylene ratio 40:60) | 65.0 |

TABLE 1-continued

| MATERIAL | ABSORPTION CAPACITY (% weight increase of the rubber) |
|---|---|
| Ethylene propylene rubber | 62.0 |
| Ethylene vinyl acetate rubber | 121.0 |
| EPDM/silicone blend (Shin Etsu 1411) | 68.0 |
| Silicone rubber mixed with 43% graphite (specific surface graphite = 15 $m^2/g$) | 4.0 |
| Silicone rubber mixed with 6% carbon black with specific surface 265 $m^2/g$ | 7.0 |
| Silicone rubber mixed with 5% carbon black with specific surface 900 $m^2/g$ | 9.8 |
| Silicone rubber mixed with 12% carbon black | 10.7 |
| Methyl phenyl silicone rubber | <0.6 |
| Fluorosilicone rubber (General Electric FSE 2120) | 0.6 |
| n-butyl rubber | 61.0 |

In practice it has been found that materials which can absorb distearyl ketone to more than 5% of their own weight are very suitable as absorbent material on the cleaning means. Reasonably good results are obtained with aliphatic rubbers, preferably selected from the group consisting of ethylene propylene diene rubber, ethylene propylene rubber, ethylene vinyl acetate rubber, halogenated or non- halogenated n-butyl rubber, and ethylene propylene diene rubber/silicone rubber blend. Rubber materials which are compounded with more than 5% and preferably more than 10% of a highly structured carbon black are preferred.

Examples of usable rubber materials are the above rubbers and condensation, peroxide and addition-hardened silicone rubbers. Suitable carbon blacks have a high specific surface, i.e. higher than 200 $m^2/g$ and preferably higher than 500 $m^2/g$. Rubber materials which are compounded with such carbon blacks have sufficient absorption capacity and an absorption speed which is much higher (more than ten times as high) than with the previously mentioned rubbers. In addition, such rubber/carbon black mixtures have impurity-binding properties, thus preventing any carry back of impurities from the cleaning means to the top layer of the intermediate.

PREFERRED EMBODIMENTS

The invention is explained in detail with reference to the following examples, which are intended to illustrate, but not limit, the scope of the present invention.

EXAMPLE 1

In the apparatus according to FIG. 1, with an intermediate belt as described in EP-A-0 349 072, the cleaning means is in the form of a 50 mm thick metal cylindrical roller provided with a 10 mm thick layer of EPDM rubber. The concentration of dialkyl ketones, such as distearyl ketone, in the top layer of the intermediate after making 205,000 copies on alkaline paper, was less than 4 mg dialkyl ketones per g top layer rubber. There was no deposition on the photoconductive belt.

The concentration of dialkyl ketones in the top layer after the same number of copies had been made, but without the use of the cleaning means, was about 6 mg/g top layer rubber. Impurities were also deposited on the photoconductive belt, resulting in image disturbance.

EXAMPLE 2

The apparatus according to FIG. 1 was provided with an intermediate belt 12 in accordance with Example 1, the top layer of which contained about 2.5 mg/g dialkyl ketones. This intermediate belt 12 was then brought into contact with a cleaning means 35 provided with a 2 mm thick layer of silicone rubber in which about 10% by weight of carbon black having a specific surface of 500 $m^2/g$ had been mixed. After the intermediate belt 12 had operated for five hours against the cleaning means 35, during which time the intermediate belt 12 was kept at 100° C. by means of the radiator 17, the concentration of ketones was halved. In similar tests in which the silicone rubber with carbon black was replaced by EPDM rubber, the ketone concentration after ten hours was still about 1.4 mg/g. In a similar test in which the cleaning means 35 was provided with ethylene vinyl acetate rubber, the ketone concentration in 15 hours dropped from 4.9 to 2.9 mg/g. The roller 36 can be heated internally or externally in order to accelerate the diffusion of impurities in the absorbent material.

A cleaning means 35, as described immediately above, can be maintained continuously in contact with the intermediate 12. The cleaning means 35 may also be provided with a mechanism (not shown) in order to lift the cleaning means from the intermediate during periods in which copying takes place. This obviates excessive heat dissipation during copying. In another embodiment, the cleaning means 35 may be formed by an endless belt trained about two shafts and having a layer of impurity-absorbent material. It is also possible to provide the outside of the absorbent material with a thin impurity-passing outer covering to improve the mechanical properties, to obviate charging and wear and to improve surface properties (non-stick and the like).

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrostatic imaging apparatus comprising:

an image-forming medium having a toner image developed on a top layer thereof, an endless movable intermediate member provided with a top layer which, in a first transfer zone, is brought in contact with said developed toner image on said top layer of said image-forming medium, heating means for heating said toner image on said top layer of said intermediate member, a pressure applying means which, in a second transfer zone, can be brought into contact with said intermediate member, transport means for transporting a toner image receiving material through said second transfer zone, and a cleaning means following said second transfer zone, positioned between said second and first transfer zones, brought into contact with said top layer of said intermediate member, wherein said cleaning means is provided on its outer surface with an impurity-absorbent material having an affinity for low melting point impurities.

2. An apparatus according to claim 1, wherein said absorbent material comprises a rubber material.

3. An apparatus according to claim 2, wherein said absorbent material can absorb distearyl ketone in an amount equal to more than 5% of the weight of said impurity-absorbent material..

4. An apparatus according to claims 2 or 3, wherein said impurity-absorbent material is selected from the group consisting of ethylene propylene diene rubber, ethylene propylene rubber, a mixture of ethylene propylene diene rubber and silicone rubber, ethylene vinyl acetate rubber, n-butyl rubber and mixtures thereof.

5. An apparatus according to claims 2 or 3, wherein said impurity-absorbent material comprises a rubber material in which at least 5% carbon black is mixed, said rubber material being selected from the group consisting of ethylene propylene diene rubber, ethylene propylene rubber, n-butyl rubber, ethylene vinyl acetate rubber, silicone rubber and mixtures thereof.

6. An apparatus according to claim 5, wherein at least 10% carbon black is mixed in said impurity-absorbent rubber material.

7. An apparatus according to claim 5 wherein said mixed-in carbon black has a specific surface of more than 200 $m^2/g$.

8. An apparatus according to claim 5, wherein said mixed-in carbon black has a specific surface of at least 500 $m^2/g$.

9. A method for removing low melting point impurities from a surface of an intermediate transport member during an electrostatic imaging process comprising:

developing a toner image on a top layer of an image-forming medium, transferring said toner image from said image-forming medium to a top layer of an endless movable intermediate member in a first transfer zone by bringing said developed toner image into contact with said top layer of said intermediate member, substantially simultaneously heating said toner image on said top layer of said intermediate member while applying pressure in a second transfer zone to said top layer of said intermediate member having said toner image thereon while introducing a toner image receiving material through said second transfer zone thereby selectively transferring said toner image to said image receiving material, and following said image transfer, cleaning said top layer of said endless intermediate member by contacting said intermediate member with a cleaning means provided on its outer surface with an impurity-absorbent material having an affinity for low melting point impurities.

10. A method according to claim 9, wherein said absorbent material comprises a rubber material.

11. A method according to claim 10, wherein said absorbent material can absorb distearyl ketone in an amount equal to more than 5% of the weight of said impurity-absorbent material.

12. A method according to claims 10 or 11, wherein said impurity-absorbent material is selected from the group consisting of ethylene propylene diene rubber, ethylene propylene rubber, a mixture of ethylene propylene diene rubber and silicone rubber, ethylene vinyl acetate rubber, n-butyl rubber and mixtures thereof.

13. A method according to claims 10 or 11, wherein said impurity-absorbent material comprises a rubber material in which at least 5% carbon black is mixed, said rubber material being selected from the group consisting of ethylene propylene diene rubber, ethylene propylene rubber, n-butyl rubber, ethylene vinyl acetate rubber, silicone rubber and mixtures thereof.

14. A method according to claim 13, wherein at least 10% carbon black is mixed in said impurity-absorbent rubber material.

15. A method according to claim 13 wherein said mixed-in carbon black has a specific surface of more than 200 $m^2/g$.

16. A method according to claim 13, wherein said mixed-in carbon black has a specific surface of at least 500 $m^2/g$.

17. An electrostatic imaging apparatus comprising:

an image-forming medium having a toner image developed on a top layer thereof, an endless movable intermediate member provided with a top layer which, in a first transfer zone, is brought in contact with said developed toner image on said top layer of said image-forming medium, heating means for heating said toner image on said top layer of said intermediate member, a pressure applying means which, in a second transfer zone, can be brought into contact with said intermediate member, transport means for transporting a toner image receiving material through said second transfer zone, and a cleaning system comprising a first cleaning means following said second transfer zone, for removing high melting point impurities from said intermediate member and a second cleaning means positioned between said first cleaning means and said first transfer zone, brought into contact with said top layer of said intermediate member, wherein said second cleaning means is provided on its outer surface with an impurity-absorbent material having an affinity for low melting point impurities.

18. A method for removing low melting point impurities from a surface of an intermediate transport member during an electrostatic imaging process comprising:

developing a toner image on a top layer of an image-forming medium, transferring said toner image from said image-forming medium to a top layer of an endless movable intermediate member in a first transfer zone by bringing said developed toner image into contact with said top layer of said intermediate member, substantially simultaneously heating said toner image on said top layer of said intermediate member while applying pressure in a second transfer zone to said top layer of said intermediate member having said toner image thereon while introducing a toner image receiving material through said second transfer zone thereby selectively transferring said toner image to said image receiving material, following said image transfer, first cleaning said top layer of said endless intermediate member by contacting said intermediate member with a cleaning means for removing high melting point impurities from said top layer of said intermediate member, and following said first cleaning step, performing a second cleaning of said top layer of said intermediate member by a second cleaning means which is brought into contact with said top layer of said intermediate member, said second cleaning means being provided with an outer surface of an impurity absorbent material for removing the low melting point impurities from said top layer of said endless movable intermediate member.

* * * * *